United States Patent [19]

Richard

[11] Patent Number: 4,977,621

[45] Date of Patent: Dec. 18, 1990

[54] GENERAL UTILITY HAND-GRIP ASSIST PAD

[75] Inventor: J. Robert Richard, 11389 Ironwood Rd., San Diego, Calif. 92131

[73] Assignee: J. Robert Richard, San Diego, Calif.

[21] Appl. No.: 427,580

[22] Filed: Oct. 27, 1989

[51] Int. Cl.[5] ..... A41D 13/08

[52] U.S. Cl. ..... 2/20; 2/161 A; 272/93

[58] Field of Search ..... 2/20, 161 A, 16

[56] References Cited

U.S. PATENT DOCUMENTS

| | | | |
|---|---|---|---|
| 300,948 | 5/1989 | Harris et al. | D24/64 |
| 2,547,388 | 4/1951 | Griffin | 2/20 |
| 2,845,628 | 8/1959 | Dell | 2/20 |
| 2,867,814 | 1/1959 | Mills, Jr. | 2/20 |
| 3,066,306 | 12/1962 | Thömas | 2/20 |
| 3,146,463 | 9/1964 | Wargo | 2/20 |
| 3,381,304 | 5/1968 | Coco | 2/20 |
| 3,398,951 | 8/1968 | Disko | 273/54 |
| 3,896,498 | 7/1975 | Pang | 2/20 |
| 4,067,063 | 1/1978 | Ettinger | 2/16 |
| 4,400,829 | 8/1983 | Willis | 2/16 |
| 4,556,992 | 12/1985 | Drury | 2/20 |
| 4,617,684 | 10/1986 | Green | 2/20 |
| 4,624,016 | 11/1986 | Luevano | 2/161 A |
| 4,754,499 | 7/1988 | Pirie | 2/20 |

FOREIGN PATENT DOCUMENTS

| | | | |
|---|---|---|---|
| P15585 | 9/1956 | Fed. Rep. of Germany | 2/20 |

*Primary Examiner*—Daniel M. Yasich

[57] ABSTRACT

A one piece multi-purpose hand-cushioning device providing protection to the palm area of the hand from trauma associated with athletic and job-related activities. The device embodies a grip enhancement feature useful in many activities requiring prolonged use of the hands, such as driving, carpentry, etc., and may be used as a therapeutic aid for users with physical limitations due to crippling effects of arthritis, muscular dystrophy, and other diseases effecting the joints and muscles of the hands and fingers. The pad is manufactured from die cut neoprene with a bonded nylon backing, with or without an additional bonded raised cushion in the palm area. Four finger holes are provided thus eliminating the requirement for any type of fasteners. The object to be gripped is thus held between the fingers and the pad more securely and with less effort than with the hand alone. Because of its symmetrical design, the pad may be worn on either hand.

2 Claims, 1 Drawing Sheet

FIG.-1
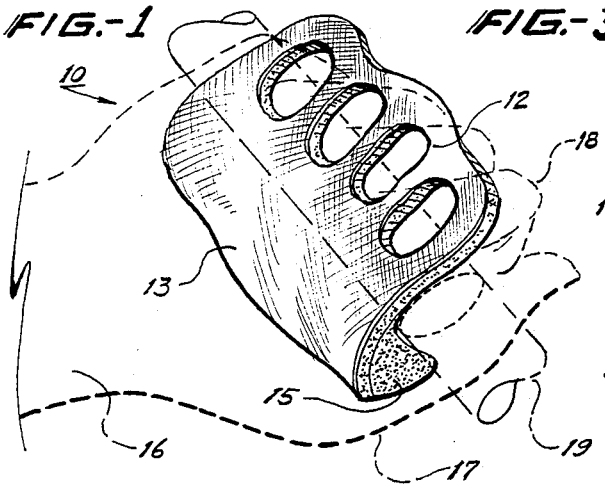
FIG.-3
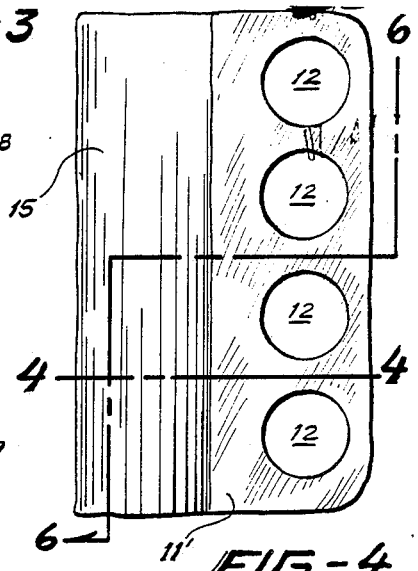
FIG.-2
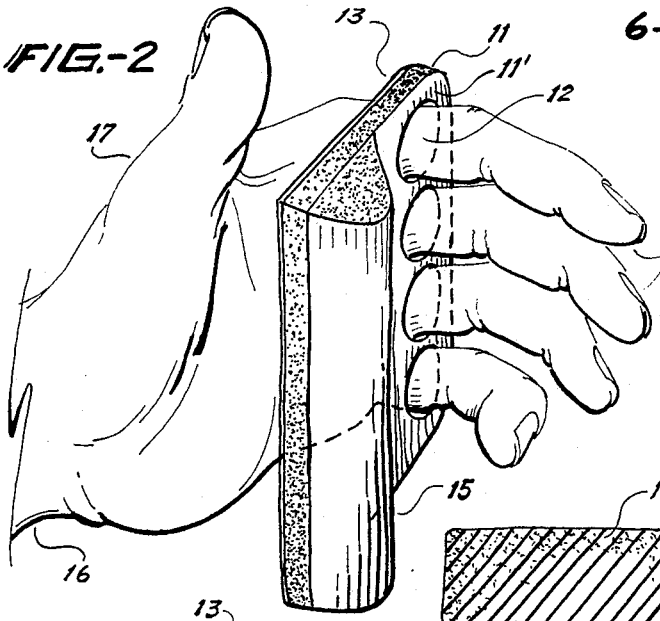
FIG.-4
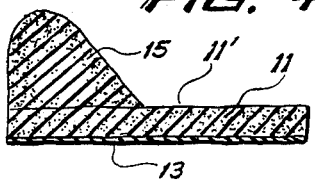
FIG.-5
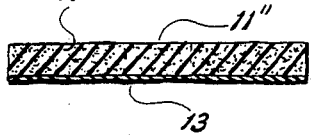
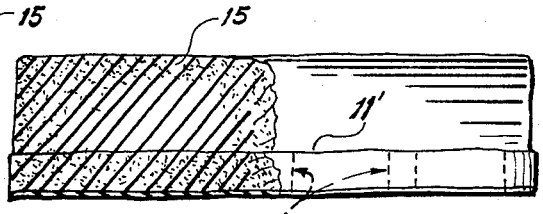
FIG.-6
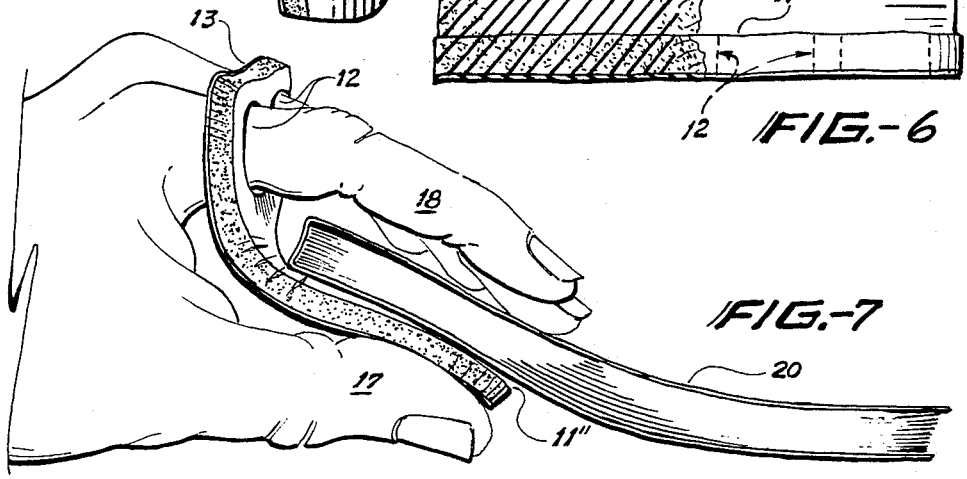
FIG.-7

GENERAL UTILITY HAND-GRIP ASSIST PAD

BACKGROUND OF THE INVENTION (A) This invention relates to hand worn grip assist means, and particularly to resilient pads specifically protective of only the user's palm region; while facilitating enhanced griping action via greater coefficient of friction.

(B) Review of prior-art reveals particular interest in protecting the palm of the hand from induced skin abrasion and nerve trama when engaged in sports or work which requires one to exert a comparatively tight grip upon an object such as a baseball-bat, weightlifting-bar, bicycle handlebar, etc.; which objects tend to impose a highly concentrated pressure upon the generally unprotected inner hand surface.

Various glove designs have been resorted to which may cover all or part of the hand, although special versions related to this invention may delete covering of the fingers so as to concentrate on protecting the palm of the hand essentially.

Perhaps the best example of such related art is revealed in U.S. Pat. No. 4,754,499 (Filed- 6/87) wherein the Inventor has set forth a rather triangular kidney shaped planar pad of resilient rubber material having a nylon backing for reinforcement along with a plurality of loops formed from a separate length of similar material cut in a strip which is appropriately stitched at five intervals upon the nylon side of the pad so as to create suitable finger holds. The article is intended primarily for enhanced hand gripping action, so there is no provision for any additional manner of padding other than the relatively thin composite material itself.

Other examples of prior art pertaining to hand-pads attaching to the fingers is found in U.S. Pat. No. 3,398,951 (filed- 3/65) and U.S. Pat. No. 2,547,388 (filed- 12/48); wherein the former is a bowler's finger-pad which receives all four fingers into a commonly looped strip of resilient material similar to the above material, although this article is worn only about half-way down toward the finger-crotch region where the affixed pad portion extends transversely across between the two outer fingers. The latter example is a protective hand-pad which involves a similar series of four finger-loops in conjunction with an attached palm-pad having a hole for the protrusion of the thumb where the resilient pad wraps partily around the back of the hand and is secured by two snap-on straps.

Still other somewhat less pertinent examples are seen in the fingerless and thumbless partial glove embodiment of U.S. Pat. No. 2,845,628 (10/54), the golfers hand-grip wraping pad of U.S. Pat. No. 2,867,814 (9/56), leather sports hand-pad of U.S. Pat. No. 4,617,684 (10/86), and finger attaching gymnast's hand-grip of U.S. Pat. No. 3,381,304 (7/65); all of which serve to essentially protect the palm of the hand, albeit in a manner of simplicity unlike that resorted to by the invention now to be revealed.

This invention shall hereinafter be generally referred to as the 'palm-pad', but is presently the subject of initial manufacturing as the "Pow'rPad"$_{TM}$ product under auspices of the EZ-GRIP Mfg.& Mkt.Co., Div. Sports Products Consultants of San Diego, California.

SUMMARY OF THE INVENTION

The invention now being set forth comprises a resilient protective pad article adapted to a general purpose hand-grip palm-pad substantially covering the palm region of the user's hand, and is intended to be employed in various ways as shall become more clear to the reader as this disclosure proceeds. Hence, the principal objects of this invention are:

(A) To provide an ultimately simple and inexpensive while very effective means by which to produce a non-glove type of configuration, preferably die-cut from standard roll-stock of closed-celled frothed-neoprene material having a layer of 2-way stretch-nylon fabric permanently bonded thereto serving to reinforce integrity of the pad.

(B) To provide a new and useful one-piece configuration for a protective hand-grip palm-pad article which obviates popular conventional use of an overlaying series of finger receiving loops in preference to a series of four preferably equally spaced simple die-cut finger-holes into which the fingers are merely inserted and extended well up to their crotch base region normally.

(C) To provide a hand-grip palm-pad having a resiliently flexile and elastic quality facilitating quick and easy passage of the user's fingers for normal installation, whereby the die-cut finger-holes are capable of being elastically distorted so as to virtually accommodate any size variance between individuals.

(D) To provide a hand palm cushioning-pad adapted for passive retention upon the user's hand via engagement of the fingers therethrough; whereby even during straightening of the fingers finds the pad retained to the hand, although tending to thus extend outward substantially perpendicular to the surface of one's open palm regardless as to various attitude orientations or positioning of the hand relative to azimuth, pitch, and elevation; this action of the pad serving to effectively eliminate any otherwise tendancy of the pad to build-up a sweaty palm, by allowing natural evaporation to take place whenever the fingers are simply extended.

(E) To provide a hand grip enhancing pad preferably comprised primarily of a flat planar sheet of resiliently flexile closed-celled foam-rubber like material which may be finished with a relatively low-coefficient surface on one side while the opposite gripping side is to be finished with a relatively hi-coefficient of friction produced by the lightly textured surface resulting from the natural slicing procedure involved in cutting the foam into thin $\frac{1}{8}$-inch to $\frac{1}{4}$-inch layers from a larger block of foam stock.

(F) To provide a rectangular shaped cushioning-pad according to item-E above, whereby the pad is preferably die-cut with four fairly equally spaced finger-holes along one of the two longer sides, and could include an additional approximately $\frac{1}{2}$-inch thickness of a similarly resilient and flexile foam-rubber beading along the alternate opposite long edge; said beading to extend sufficiently outward from the planar surface of the pad so as to effect an artificially pronounced lower-palm for the thus equiped hand.

BRIEF DESCRIPTION OF THE GRAPHIC REPRESENTATIONS

The preceeding objects and other advantages of the present invention will become more readily apparent from study of the following detailed descriptions of the drawing illustrations, wherein number designations in the invention specification are given reference to like points, parts, and features of the graphically represented disclosure.

FIG. 1, is a pictorial view of the invention as it appears slightly distorted when installed upon the bare closed hand of a user, while being viewed from the upper oblique wrist region position; the hand and grasped object being represented in phantomed outline manner for greater visual clearity.

FIG. 2, is a pictorial perspective view of the invention as it appears installed upon the bare hand of a user, while being viewed toward the underside of an open hand position.

FIG. 3, is a plan view looking toward the planar surface area of the invention.

FIG. 4, is a cross-section view taken along reference line 4—4 of FIG. 3.

FIG. 5, is a cross-section view of an alternate embodiment of the invention, viewed along the same reference line 4—4 but remiss of the protruding palm cushion.

FIG. 6, is a partial cross-section elevation view taken along reference line 6—6 of FIG. 3.

FIG. 7, is a pictorial end-view of the alternate embodiment in FIG. 5, showing the particular manner of usage it provides.

DESCRIPTION OF THE PREFERRED EMBODIMENTS

Reference to FIG. 1 shows a very clear example of how the invention is generally employed, wherein the phantomed hand upon which it is being worn is seen grasping an object such as a baseball-bat handle or weightlifting-bar. Notice here how the very supple structure of the invention 10 easily distorts to readily accommodate insertion of the four fingers through the finger receptacle holes 12, while allowing the thumb to remain free to serve its natural opposing function. Note also how the special protruding lower palm cushion portion 15 acts to set the exemplified bat-handle 19 further outward from the lower palm region toward the base of the fingers and away from the crotch of the thumb 17, giving the top hand on a baseball-bat for example, more extension and actual leverage without loss of desired control. Tests show this improved leverage translates into greater bat-speed for a given degree of wrist/arm motion, along with much more comfort than can be realized with a comparatively costly batting-glove alone. If worn outside of a batting-glove, a pad size larger is required, but use of this palm-pad alone not only gives improved bat-grip/control, but effectively absorbs dreaded painful bat impact vibration and blisters. Golfers also find this palm-pad gives similar unusual swing performance enhancement, along with mitigating of trauma and bruising to the tissue and bones of the thumb, wrist, and tendonitis of the elbow. Moreover, it has been found that even non-sport 'task activities' which can also cause outer hand trauma, such as is encountered during hammering, shoveling, and steering-wheel or machine lever operating, are noticably alleviated from trauma.

While the palm-pad 10 is preferably employed with its high-friction surface 11' facing outward from the palm as in FIG. 2, baseball catchers often prefer to reverse the direction of installation upon the fingers, so that the integrally molded 2-way/stretch reinforcement backing 13 faces toward the fingers instead, owing to the easier insertion of the thus equipped hand into the catchers-glove. Some users even like to scissor away certain portions of the pad they may personally feel excessive for their hand physiognomy, but this is an individual thing.

An alternate embodiment is set forth in FIG. 7 which is found to be more appropriate for those users afflicted with arthritis of the hand. Arthritic's experience substantial relief from pain during grasping of objects such as the exemplified soft-cover book 20, owing to the measurably reduced finger motion and exertion required to adaquately grasp and hold such everyday items.

Additionally, endro-cyclists are often afflicted with a serious nerve paralyzing condition caused by their having to support much of the upper-body weight upon the palms of their hands during gripping of the rigid handlebar member. Employment of this specialized palm-pad greatly ameliorates this debiliating condition, enabling the cyclist to thus proceed without difficulty; resulting in renewed ability to actuate shifts, steer, and operate brake-levers in a much more precise and comfortable manner. Furthermore, induced trauma upon the wrist-joints is also substantially reduced here, as it is with baseball batting, by virtue of this palm-pad's shock-absorbing properties; particularly, the version of the invention represented in FIG's. 1 and 2.

As was mentioned, use of the invention extends the 'effective radius' of the topmost hand/arm during batting action, since it places the grip of the bat-handle further out towards the fingers without loss of grip force upon the handle. In addition, since the inertia of the advancing bat tends to compress the foam pad, particularly during the vital accelerative phase of the swing, the decompressive energizing of the resilient foam pad is rebounded to the bat; in a manner not unlike the action of a compressed spring. Hence, dependent upon the timing of the batter's swing, this reaction of the foam can contribute a more explosive batspeed, to positively effect the ensuing impact contact with the ball, for demonstratively greater ball travel. In the highly competitive game of baseball, even a seemingly modest one-to-two percent improvement gain in resultant impact energy can make the difference between an out and a homerun.

Additionally, the benefit eluded to previously regarding debilitating bat strike vibration or "ringing", results when the ball strikes at a critical point region of the bat surface somewhere off of it center-of-gravity thereby setting up a resounding resonance frequency at the lighter handle end of the bat (which varies with the particular grain structure, length, and contour of the wooden bat). This imparts a numb tingling condition to the batter's hand which is at least temporarily disabling to a batter because of it's trauma to the hand nerves and tissue. This is the primary reason why most skilled batters use a batting-glove on their hand which suffers the most. To a large measure, this invention protects against this dreaded physiological condition, while enhancing batspeed characteristics.

The unique cross-section shape revealed in FIG. 4 shows how the basic gripping pad configuration of FIG. 5 is enhanced for sport uses via adaption of a special protruding cushion portion 15 made integral upon the essential planar surface of the foam pad portion 11.

The construction of the palm-pad is preferably comprised of a closed-cell type of nitrogen frothed neoprene-rubber composition, preferably having a vital 2-way stretch nylon fabric backing substrate 13, while the protruding cushion 15 is generally of a slightly higher-density foam. The flat pattern projection view of FIG. 3 shows how the four nominally sized and equidistantly spaced finger receiving holes 12 are arranged close along one of the longer sides of the preferably rectangular pad layout, while the optional lower-palm pad portion 11 is arranged oppositely along the far alternate side of the surface 11'. Because of the availability of quality controlled foam-neoprene such as is produced by the Rubatex Corp. (USA), the inventor prefers to make the palm-pad article out of commercial roll-stock material of ⅛th to ¼-inch gauge in a simple die-cutting procedure; whereupon the optional lower-palm pad entity 15 is permanently applied to certain of the units via conventional adhesive-bonding method. Note also, that the finely textured 'unskinned' surface 11' is achieved by cutting of the pad material from a thickly molded block of foam material, thereby presenting an ideal high/coefficient-of-friction toward the gripped object while the obverse side surface 13 presents a relatively low-coefficient of friction.

Study of FIG. 2 shows how the palm-pad tends to naturally extend outward substantially perpendicularly from the user's bare palm surface, thereby achieving an advantageous automatic aeration action whenever the hand is opened to a relaxed position. Thus serving to dissipate any appreciable amount of palm perspiration, resulting in maintenance of the firm grip needed to perform so many hand tasks this invention may be called upon to assist. When initially gripping an object, the palm-pad takes a natural 'lay' against both the palm and the object, and virtually becomes a subconscious action not requiring any special adjustments.

The physiotherapeutic qualities of this palm-pad stem from the manner in which the invention is attached near the base of the first-metacarpal (thumb) to the second and third metacarpals particularly. This adductor-pollicis muscle region is especially prone to injury in the form of a deep bone bruise, and also trauma to the sensitive nerves beneath the palmar surface region which is covered by the distal fibrous sheath covering the median-nerve(where it branches into the common palmar digital nerves, and the so called deep palmar arch branch of the ulnar-nerve); particularly the abjuctor and flexor-pollicis longus & brevis at the base of the first-metacarpal.

The appended Claims of this invention are structured to encompass and embrace any modifications considered to be within the spirit and scope of the invention, including right and left hand usages. This specification and Claims have been thus prepared in accordance with prevailing patent rules & regulations promulgated under the authority of the U.S Patent Office in Washington D.C.

I claim:

1. An apparatus providing both cushioning to the palm and improved gripping when worn on a user's hand, comprised of a pad made from a material formed by a simple die-cut procedure, and adapted for passive retention to the hand by simple insertion of the fingers through four equally spaced holes, the apparatus is manufactured from elastic material of sufficient thickness and resiliency whereby straightening of said fingers enables the pad to extend outward substantially perpendicular to the surface of the open palm of the user regardless of the attitude disposition of the hand, thus allowing for the evaporation of perspiration, the apparatus shall have a permanently bonded layer of nylon fabric on at least one of the sides of said pad serving to reinforce the mechanical integrity of the pad and providing a low coefficient of friction between the pad and the palm, thus eliminating the possibility of blisters forming on the palm during extended periods of use.

2. An apparatus providing both cushioning, improved gripping, and protection to the nerves and muscles of the hand, particularly in the crotch area formed by the thumb and forefinger, comprised of a pad made from a material formed by a simple die-cut procedure and adapted for passive retention to the hand by simple insertion of the fingers through four equally spaced holes, and reinforced along the edge opposite and parallel to the finger holes with an additional layer of bonded material facing away from the palm, thus creating an extension of the palm against which an object may be gripped, with greater security, and with less force required by the fingers, the apparatus is manufactured from elastic material of sufficient thickness and resiliency whereby straightening of said fingers enables the pad to extend outward substantially perpendicular to the surface of the open palm of the user regardless of the attitude disposition of the hand, thus allowing for the evaporation of perspiration, the apparatus shall have a permanently bonded layer of nylon fabric on at least one of the sides of said pad serving to reinforce the mechanical integrity of the pad and providing a low coefficient of friction between the pad and the palm, thus eliminating the possibility of blisters forming on the palm during extended periods of use.

* * * * *